US010240889B1

(12) United States Patent
Murray

(10) Patent No.: US 10,240,889 B1
(45) Date of Patent: Mar. 26, 2019

(54) APPARATUS AND METHOD FOR A PNEUMATIC GUN TO USE A FLUID SOURCE VIA AN ADAPTOR

(71) Applicant: Alexander Tahkodah Murray, Maryville, MO (US)

(72) Inventor: Alexander Tahkodah Murray, Maryville, MO (US)

( * ) Notice: Subject to any disclaimer, the term of this patent is extended or adjusted under 35 U.S.C. 154(b) by 0 days.

(21) Appl. No.: 14/990,253

(22) Filed: Jan. 7, 2016

Related U.S. Application Data

(60) Provisional application No. 62/101,222, filed on Jan. 8, 2015.

(51) Int. Cl.
*F41B 11/682* (2013.01)
*F41B 11/73* (2013.01)

(52) U.S. Cl.
CPC ..... *F41B 11/682* (2013.01); *F41B 11/73* (2013.01)

(58) Field of Classification Search
CPC ..... F41B 11/60; F41B 11/62; F41B 11/68; F41B 11/681; F41B 11/682; F41B 11/73
USPC ..... 124/58, 56, 71, 73, 74, 75
See application file for complete search history.

(56) References Cited

U.S. PATENT DOCUMENTS 5,181,636 A 1/1993 Anderson et al.
6,036,054 A 3/2000 Grill
7,290,539 B2 11/2007 Maeda et al.
7,603,996 B2 10/2009 Wei
7,730,882 B2 6/2010 Liu
8,146,580 B2 4/2012 Wei
8,286,620 B2 * 10/2012 Williford ..... F41B 11/68 124/56
8,550,061 B2 10/2013 Maeda
8,602,784 B2 * 12/2013 Dvorak ..... F41A 33/02 434/11
2007/0000952 A1 1/2007 Gruenewald et al.
2009/0283084 A1 * 11/2009 Tran ..... F41B 11/62 124/74
2013/0214526 A1 * 8/2013 Annuzzi, Jr. ..... F41B 11/62 285/93
2013/0239937 A1 9/2013 Macri et al.

OTHER PUBLICATIONS

Pelletier, B.B., How to convert from CO2 to air, Aug. 18, 2008, Airgun Academy, pp. 1-4.*

* cited by examiner

*Primary Examiner* — Stephen Johnson
*Assistant Examiner* — Benjamin S Gomberg
(74) *Attorney, Agent, or Firm* — Polsinelli PC

(57) ABSTRACT

The present invention relates generally to an adaptor system for use with a pneumatic gun that allows for the delivery of a fluid from a tank to the chamber of the gun. The adaptor system can easily be added or removed from the cartridge cavity of a gun whereby allowing a user to easily convert between a gun that uses a cartridge system or one that can use a large tank system with an attached hose.

11 Claims, 10 Drawing Sheets

APPARATUS AND METHOD FOR A PNEUMATIC GUN TO USE A FLUID SOURCE VIA AN ADAPTOR

CROSS REFERENCE TO RELATED APPLICATION

This application claims priority from U.S. Provisional Application Ser. No. 62/101,222 filed on Jan. 8, 2015, which is hereby incorporated by reference in its entirety.

FIELD OF INVENTION

The present invention relates generally to an apparatus for adapting a pneumatic gun to use a fluid tank that connects to a fluid hose for use in delivery of the fluid to pneumatic gun instead of a single use cartridge, the method of use for the apparatus and a kit.

BACKGROUND

Pneumatic guns that include bb guns, pellet guns, air rifles, paintball guns, potato guns, water guns and ball guns are designed to use a compressed fluid, usually a gas such as air or $CO_2$ to propel a designated projectile hereafter known as a fluid. The types of guns available include many various shapes and sizes that an individual can use. The type and various methods for delivering the fluid for use in propelling a projectile includes "pump style" guns that require a user to manually pump a lever to compress air within a chamber further allowing for the compressed air to then be delivered for use in propelling the projectile. Another typical gun type includes a compressed fluid tank or disposable cartridge that is removeable connected to the gun to allow for the transfer of the fluid from the tank to the gun for propelling the projectile. The types of cartridges that can be used include aluminum or steel are well known in the industry and include but are not limited to cartridges from manufacturers such as ASG, Crossman, Gamo, JT, Daisy, Umarex, Tippmann, Benjamin, Winchester, Win Gun, WE, Tokyo Marui, Cyber Gun, KJW, WELL, and G & G to name a few. The typical cartridge holds a small amount of $CO_2$ fluid that when used with a gun is the power source. The typical cartridge size is 12 grams, but the size can range from less than 12 grams to 90 grams, with typical industry sizes including 16, 88 and 90 gram cartridges. One well known cartridge is the Powerlet $CO_2$ cartridge that has been used extensively within the industry for many years. Under normal usage the Powerlet container will help in delivering around 20-40 shots dependent on many environmental factors before a user starts to notice a decrease in velocity on the projectile. The decrease in velocity will also depend on the type of delivery means, such as via a magazine holder or use of the cartridge directly in the gun. The typical cartridge will almost after the first shot begin to lose some strength of power, with every shot becoming less and less powerful until the cartridge is completely drained. After draining the cartridge the user is then required to remove the cartridge and dispose of it. Over time the guns have continued to evolve allowing for various shapes and sizes of tanks but the typical Powerlet cartridge is still the favored method for delivery of fluid and therefore requires a user to continually reload spent cartridges and make adjustments during use because the velocity decreases as the use continues.

Therefore a need exists for a method for delivering fluid to the gun that does not require the continually reloading of a cartridge. Since the guns are designed specifically for the use of a typical cartridge design the need exists for an adaptor that will work with a typical gun for the delivery of the fluid but does not hinder the overall use of the gun or diminish the grip of a user when holding the gun. Also a need exists that allows a user to easily convert from a typical cartridge system to an adaptor system that includes a hose to a larger fluid source but can be reconfigured back to use a typical cartridge.

SUMMARY OF THE INVENTION

The present invention is directed to an adaptor systems and methods for use in a pneumatic gun. The adapter systems comprise one or more delivery tanks or conduit cartridge acting as a conduit for delivering a fluid from a fluid tank, typically external from the pneumatic gun with a delivery hose, to a pneumatic gun. The delivery tank includes an internal chamber with a first opening and second opening. The delivery tank is configured for communication with a bolt member that includes a hollowed core with a first opening and a second opening. The communication between the delivery tank and bolt member can further include a seal member to ensure an air tight connection. The bolt member further is configured to be fixedly or removeably attached to a coupling member that allows for connection to a fluid tank via a hose. The adaptor system overall allows for the delivery of a fluid from a fluid tank to a pneumatic gun.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings illustrate embodiments of the invention and are for illustration by way of example and not limitations.

DETAILED DESCRIPTION OF THE INVENTION

Figure 1:
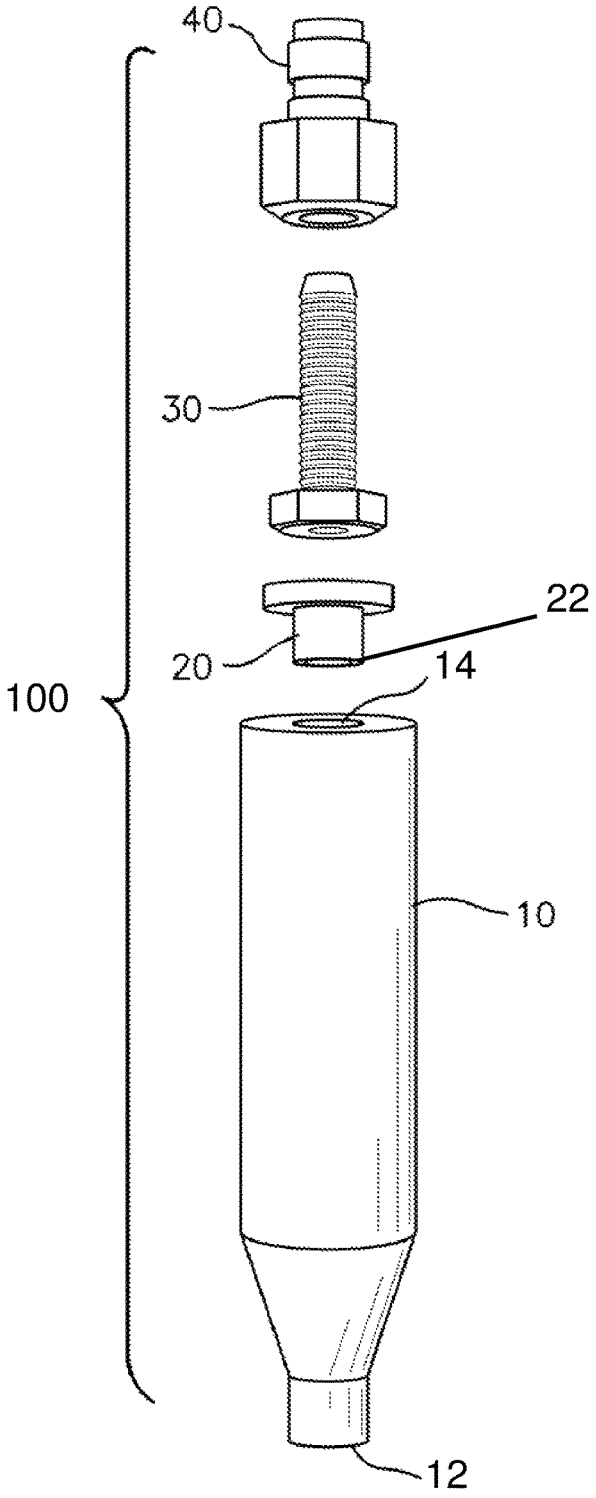
FIG. 1 illustrates all the pieces of the complete adaptor system or kit.
Figure 2A:
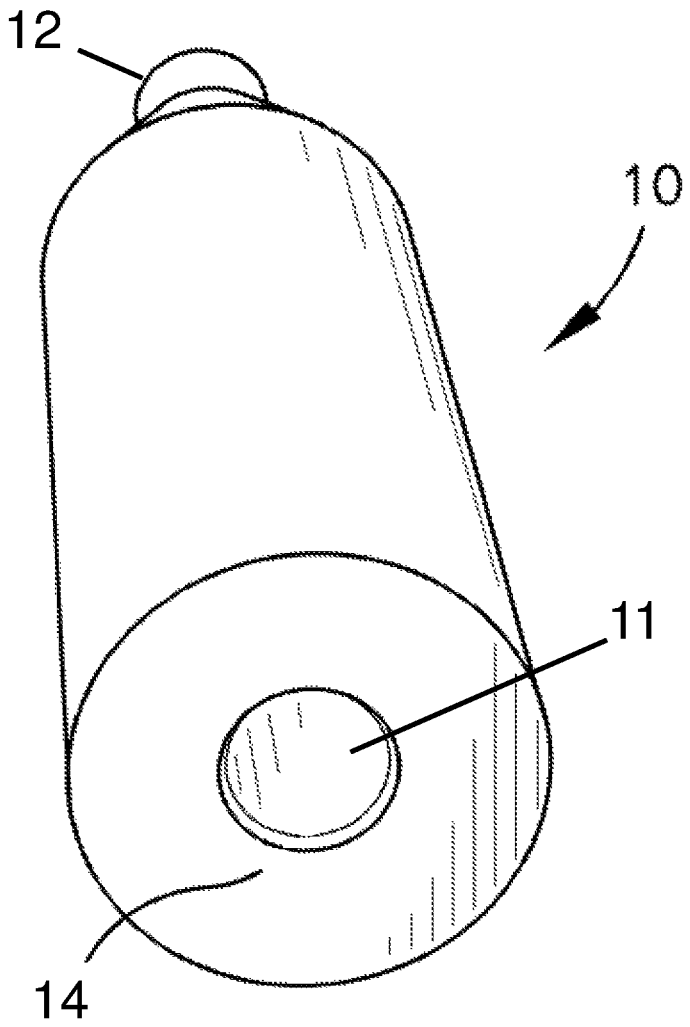
FIGS. 2*a* and 2*b* illustrate a delivery tank or canister.
Figure 2B:
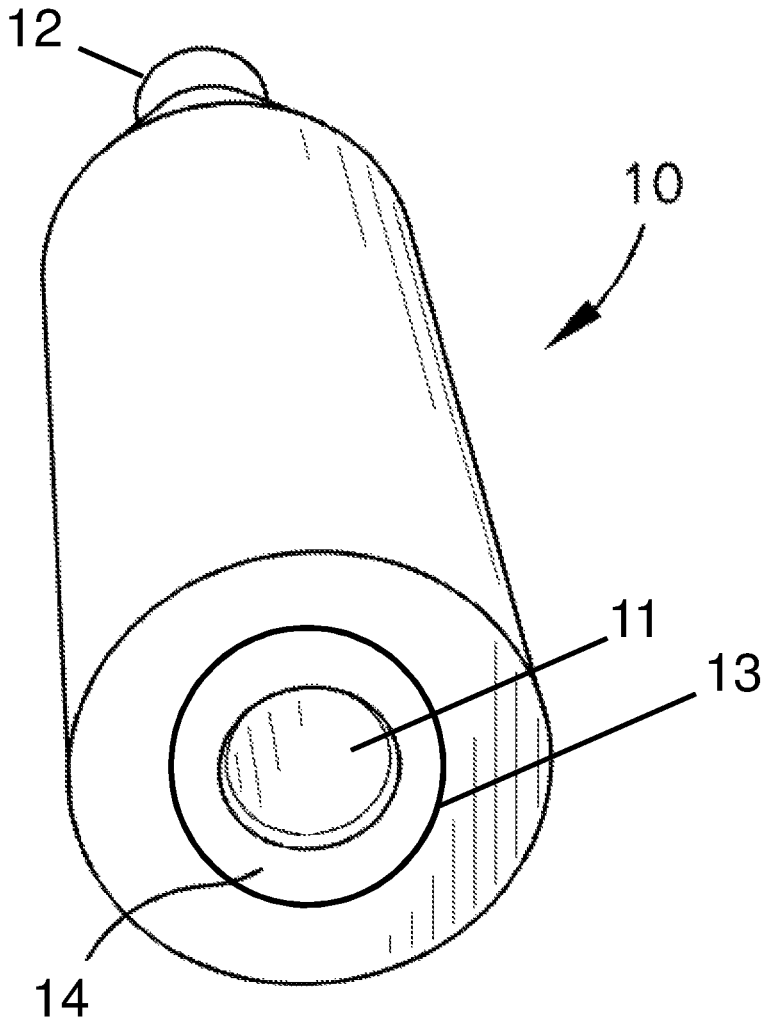
Figure 3:
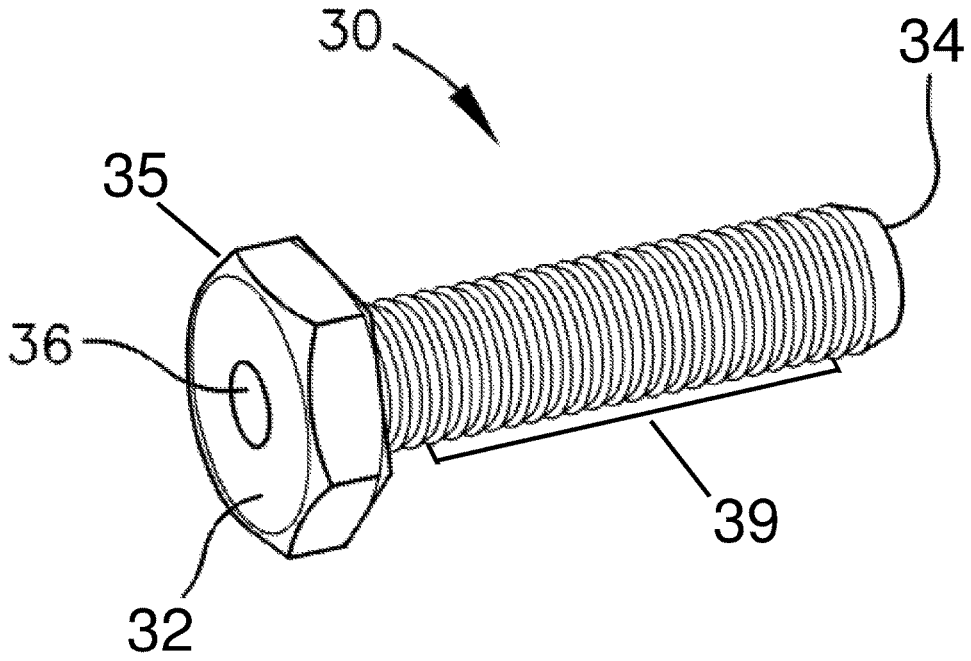
FIG. 3 illustrates a bolt member.
Figure 4:
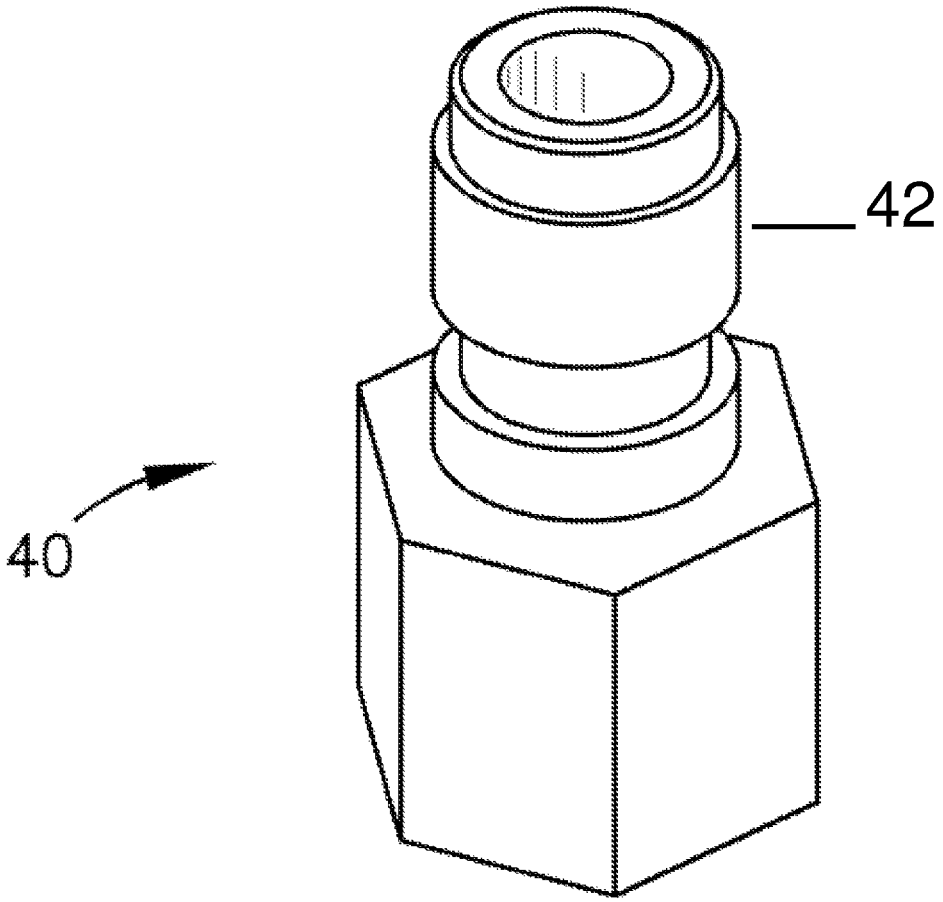
FIG. 4 illustrates a connection or coupling valve member.
Figure 5A:
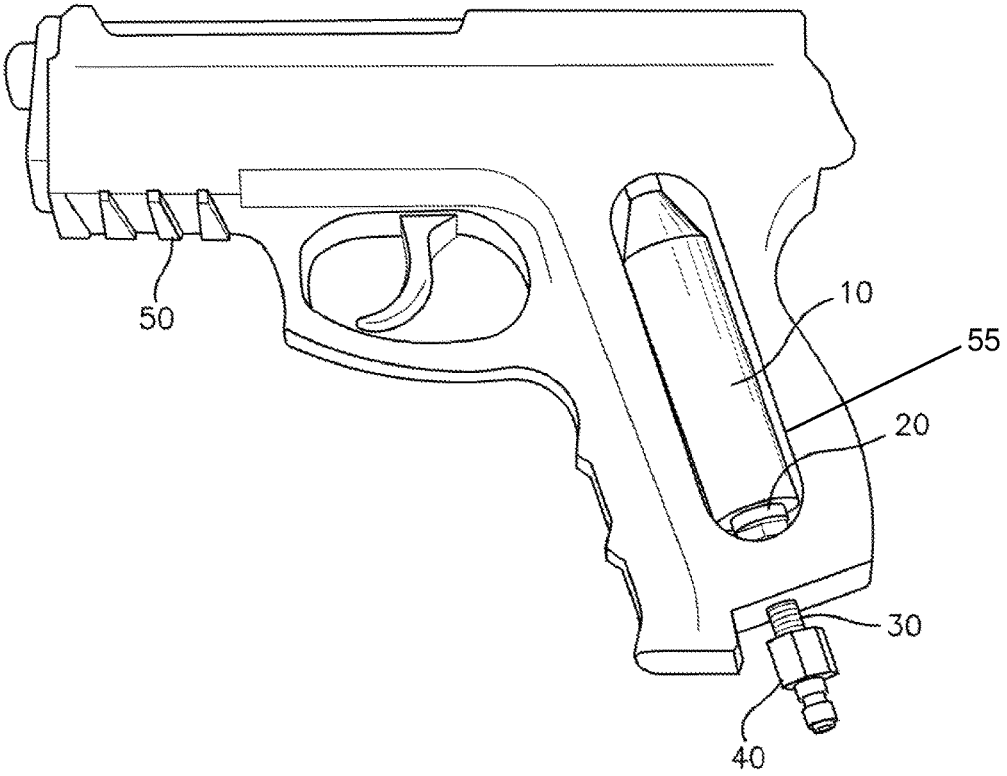
FIG. 5*a-d* illustrates installation of the adaptor system within a pneumatic gun.
Figure 5B:
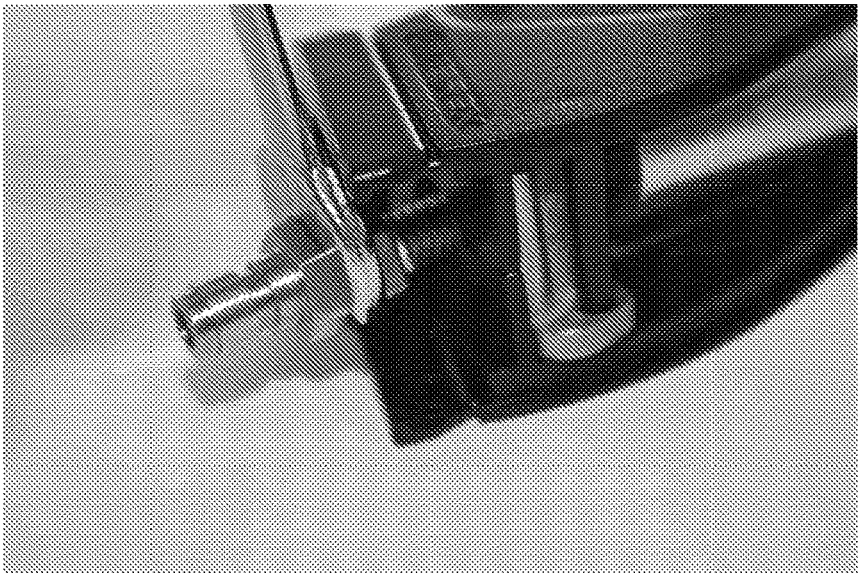
Figure 5C:
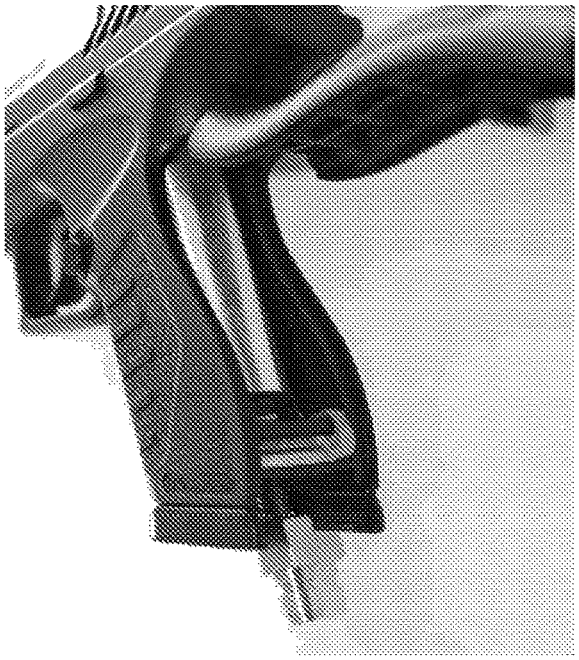
Figure 5D:
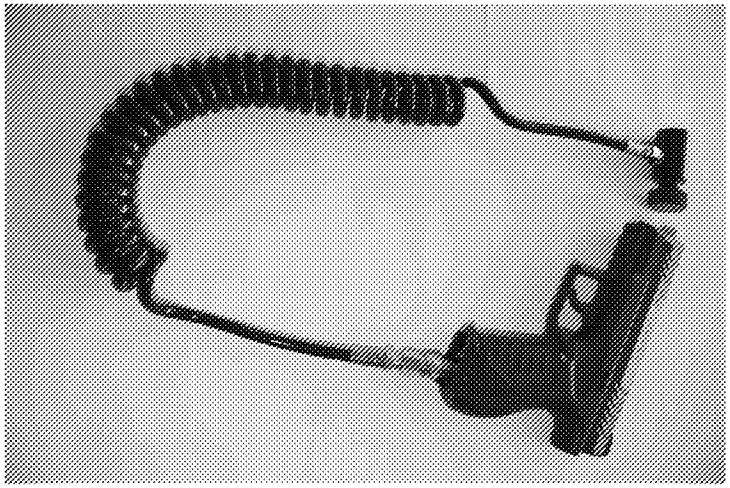
Figure 6:
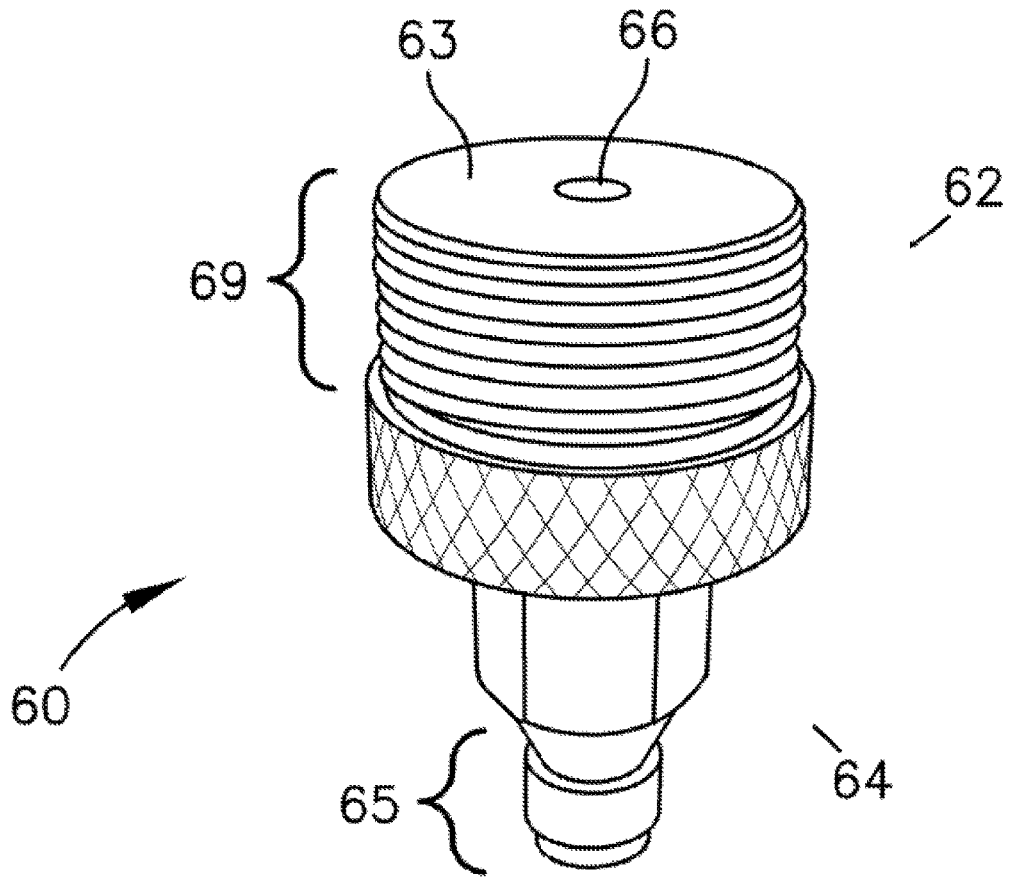
FIG. 6 illustrates an embodiment of a coupling bolt member.
Figure 7:
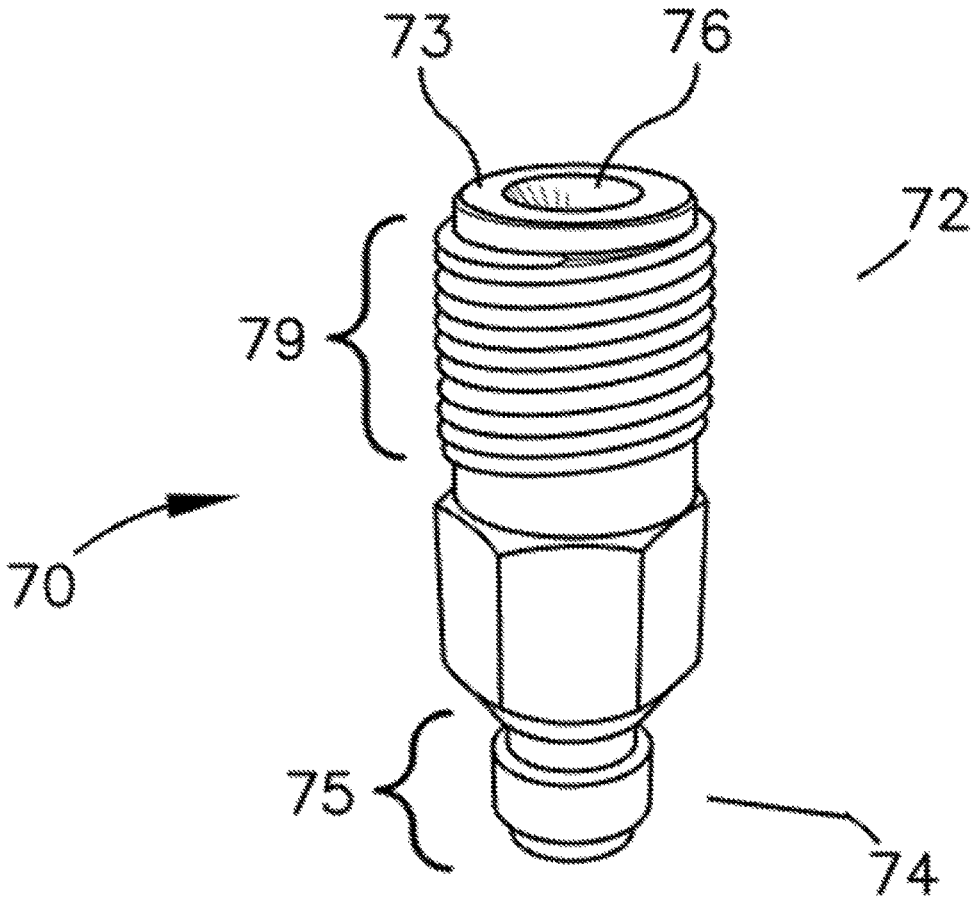
FIG. 7 illustrates an embodiment of a coupling bolt member.

The present invention is to a pneumatic gun adaptor system or kit as shown in FIGS. 1-7, a method for using, and a method for easily converting the gun from a typical cartridge system to the adaptor system and back to the cartridge system. Specifically, the invention is to an adaptor system for use with an air gun that allows for the use of a larger fluid tank to connect to the air gun via a hose for delivery to the adaptor system in the air gun then allowing for the same internal delivery system for the fluid used with a typical cartridge system.

The adaptor system is shown in multiple views in FIGS. 1-7 and the configuration provides for easily installation within a typical air gun and in particular an air hand gun for the delivery of a fluid. The universal nature of the adaptor system allows for use with any gun used on the market. To provide better illustration and context to the adaptor system the term "pneumatic gun" refers to any gun that is configured for the delivery of a fluid to propel a projectile and in particular any gun configured to use a cartridge system for delivery of the fluid. Examples of manufactures of such guns included but are not limited to ASG, Crossman, Gamo, JT, Daisy, Umarex, Tippmann, Benjamin, Winchester, Win Gun, WE, Tokyo Marui, Cyber Gun, KJW, WELL, and G & G. Examples of particular guns that the adaptor system can be used in, include but are not limited to the Crosman C11, Elite Force 1911, Crosman 2240, Umarex XBG, ASG Dan Wesson, Umarez, UZI, ASG TAV 4.5, KJW 1911, and Marushin FN Hestal Five-Seven. The list does not include every gun that can use the adaptor system but is an example of the universal nature of the adaptor system and its potential use in any gun currently or potentially made in the future. Non-limiting examples include but are not limited to bb gun, pellet gun, air rifle, paintball gun, potato gun, water gun, ball gun or any other similar gun known in the industry. Further the term "fluid" refers to any liquid or gaseous substance that can be used to propel a projectile. Non-limiting examples include $CO_2$, ambient air, $O_2$, or any other similar gas used in the industry. In addition the fluid substance can also be a liquid in a sealed environment, such as typically found in a standard Powerlet cartridge or other similar industry cartridge such that when the liquid leaves the cartridge it becomes a gas that is used to propel the projectile.

The adaptor system is configured to provide a convenient method to easily convert a typical cartridge system to a tank system, wherein the tank contains 9 oz. to 32 oz. of fluid versus the use of a adaptor system that mimics the cartridge system but connects to a larger fluid tank that contains 12 grams to 90 grams of fluid. In one embodiment the tank size is 20 oz. The conversion from a cartridge system to a tank system including the adaptor system allows a user to conveniently and effectively continually fire the gun without the requirement of replacing the cartridge after a limited number of firings. It is envisioned that a user will be able to fire thousands of rounds before the fluid tank requires replacement. Based on use in the field, a typical 20 ounce $CO_2$ tank used in a magazine style gun will be able to fire between at least 1900-2200 rounds before requiring a refill, for a direct cartridge installment gun the gun will be able to fire at least between 3800-4000 rounds compared to current systems that fire around 40 rounds.

Overall the design of the adaptor system allows a user to incorporate a tank delivery system without impeding the grip of the gun or hindering the typical hand placement of the user. The fluid tank can also allow for the delivery of a higher pressure of fluid to increase the velocity of the projectile delivered from the gun. In addition, the fluid tank used with the adaptor system may use a different fluid than normally contained in the typical cartridges used for a gun. Also, use of a tank system will decrease the amount of waste since a user will not be required to continually replace cartridges that are single use items.

In one embodiment the adaptor system is depicted in FIGS. 1-7 and is illustrative of the adaptor system and potential kit that a user can removeably incorporate into the gun. In general a gun is used that uses typical industry cartridges (such as the Powerlet). The adaptor system includes a delivery canister tank 10. The delivery tank 10 is configured to have similar dimensions to a typical cartridge used with a gun. The delivery canister can be any shape that allows it to fit within the a gun and to deliver the fluid to the gun. The diameter of such a delivery tank can vary but typically will be in the range of 1/16 of an inch to 3 inches. The length will further depend on the type of gun used but can range from 1/4 of an inch to 12 inches. The size is merely dependent to allow for the delivery of the fluid to the gun as well as the size constraints of the available gun chamber used to the cartridge or adaptor system. The delivery tank 10 will take the place of the cartridge within the gun and act as a conduit for delivering the fluid from the fluid tank to the gun. The delivery tank 10 includes a wall with a space defined within the wall or a chamber. This space can be configured to include varying dimensions of internal space with one of skill in the art specifically configuring dependent on a consumer's preference. The delivery tank includes a first end and a second end. The first end is configured to removeably connect with the gun to deliver the fluid to the gun chamber for propelling the projectile. The first end includes an opening 12 that is connected to the space defined within the delivery tank. The second end of the delivery tank is configured to include a second opening 14 that is opposite the first opening 12. The second opening 14 similar to the first opening 12 is connected to the space 11 defined within the delivery tank 10. The first opening 12, second opening 14 and defined space within the delivery tank 10 create a delivery chamber that will allow a fluid to pass through the second opening 14 into the delivery chamber and then exit the first opening 12 to engage the chamber of the gun. In one embodiment the delivery tank 10 is configured in the same shape and dimensions as a typical cartridge, with a conical funnel shaped first end, a cylindrical body, and a bottom end. In additional embodiments the delivery tank 10 can be configured in any dimension that allows for the delivery tank to fit within the confines of a typical gun without hindering or disrupting the feel of the handle when in use. The delivery tank can be made of any material known in the industry, including but not limited to aluminum, plastic, metal, wood, or any combination thereof.

The adaptor system further includes a seal member 20 configured to communicate with the second end of the delivery tank 10. The seal member allows for an air tight seal with the bolt member 30 that is further connected to the connection or coupling member 40. The seal member 10 can be designed in any configuration that allows for an air tight seal to be created between the delivery tank 10 and the bolt member 30. In one embodiment the seal member 20 includes a cylindrical design with a first raised end that allows for a removeable connection with the second end of the delivery tank 10. The first raised end of the seal member 20 allows for a male to female connection with the first raised end of the seal member 20 fitting within the opening of the second end opening 14 of the delivery tank 10. The seal member 20 configuration allows for a portion of the seal member 22 to set within the second end opening 14 of the delivery tank whereby creating an air tight connection. In additional embodiments the seal member 20 can be configured in any shape that allows for creation of an air tight seal between the bolt member 30 and the delivery tank 10 to allow for delivery of the fluid within the chamber of the delivery tank 10 and ultimately to the gun. In an additional embodiment the second end 14 of the delivery tank 10 can include a circular groove to allow for the placement of a circular gasket 13 creating an air tight connection between the bolt member 30 and delivery tank 10 when in use. In an additional embodiment the delivery tank 10 may not include a groove but still include a surface on the second end 14 of the delivery tank 10 that allows for the gasket to rest in place against the second end creating an air tight seal. The seal member 20 can be configured out of any material known in the industry as well as configured to any dimension that allows for the creation of an air tight seal between the bolt member 30 and the delivery tank 10. The design of the end 14 of the delivery tank 10 that is configured for communication with the bolt member 30 is such that any design that allows for an air tight seal to be created between the bolt member and delivery tank is envisioned. Various seals, gaskets or coupling mechanisms could be envisioned to create the desired results. Further the seal member 20 is composed of any material known in the industry that will allow for the creation of an air tight seal, such as rubber, plastic, or any flexible to semi-flexible material.

The adaptor system further includes a bolt member 30 that is configured for use with the gun. The bolt member 30 configuration allows for the bolt 30 to be placed in connection with a typical gun replacing the cartridge holding piece that creates pressure on a cartridge to ensure an air tight seal is created when the cartridge is engaged within the gun for delivery of the fluid to the gun chamber. The bolt member 30 of the adaptor system is used in place of the holding piece found in a typical gun configuration to aide in the placement of the delivery tank 10. The size can vary dependent on the gun it will be used with and can be of any dimensions that will allow for the delivery of the fluid to the gun as well as the size constraints of the available gun chamber used for the cartridge or adaptor system. As an example the bolt member could vary from ¼ of an inch to 12 inches or longer. The bolt member 30 is further configured with an internal chamber or channel that allows for the delivery of the fluid from a starting fluid tank through the coupling 40 member through the bolt member 30 through the seal member 20 into the delivery chamber and through the delivery tank 10 into the gun. The bolt member 30 can be configured to communicate with the gun including but not limited to being screwed into the gun. In an additional embodiment the bolt member 30 can be configured with any variation to allow for the connection or communication with the gun. The bolt member 30 includes a first end 32 and second end 34 the first end 32 includes a larger head 35 such as found on a typical bolt. The first head end 35 can be configured in any shape known in the industry including square, or similar geometric shape to allow for the ease of turning the bolt member 30 as well as engaging the second end 14 of the delivery tank. The configuration of the bolt head will be dependent on the desired adaptor system with the head potentially being the same size as the body of the bolt member. In another embodiment the head of the bolt member can be configured to include a rubber or pliable material to allow for communication with the delivery tank to create an air tight seal when engaged. In such a configuration to the dead for first end of the bolt member is composed of a rubber with the remainder of the body made out of metal or another material. The body to the second end 34 of the bolt member 30 includes a configuration of threads 39 that allows for placement within the gun. The threads 39 start just below the head 35 of the bolt member 30 and run to the end of the bolt member 30. In one embodiment the bolt member 30 has the same configuration as a typical bolt known in the industry but further includes a hollowed out core to create a channel 36 that runs from the first end to the second end of the bolt. The threads 39 of the bolt member 30 are further configured to allow for the placement and connection or communication of a coupling member 40 on the second end 34 of the bolt member 30. The coupling member 40 is configured in the shape and dimensions of any typical coupling member used for the delivery of fluid from one container to a second destination while still remaining under pressure. The bolt member 30 and coupling member 40 are configured out of any material known in the industry that can include but is not limited to metal, plastic or any machine workable material. It is also envisioned that the bolt member and coupling member could be composed out of a single material of a combination of materials. In one embodiment the bolt member and the coupling member are one unitary body which is a coupling bolt member 60.

In embodiments that include the coupling bolt member 60, the coupling bolt member 60 configuration allows for the coupling bolt member 60 to be placed in connection with a typical gun replacing the cartridge holding piece that creates pressure on a cartridge to ensure an air tight seal is created when the cartridge is engaged within the gun for delivery of the fluid to the gun chamber. The coupling bolt member 60 of the adaptor system is used in place of the holding piece to aide in the placement and creates communication with the delivery tank 10. The coupling bolt member 60 is further configured with an internal chamber 66 that allows for the delivery of the fluid from a starting fluid tank through the seal member 20 into the delivery chamber and through the delivery tank 10 into the gun. The coupling bolt member 60 can be configured to screw into the gun or attach by any means typically used within the industry. In an additional embodiment the coupling bolt member 60 can be configured with any variation to allow for the connection or communication with the gun. The coupling bolt member 60 includes a first end 62 and second end 64. The first end of the coupling bolt member 60 has a flat surface 63 that is configured to be in communication with the seal member 20, so that a substantially air-tight seal is formed between the flat surface 63 and the seal member 20. In another embodiment the first end 62 of the coupling bolt member can be composed of a material that will allow for communication that will create an air tight seal when engaged with the delivery tank. The first end 62 includes a configuration of threads 69 that allows for placement within the gun. The threads 69 start at the first end 62 and run to the middle of the coupling bolt member 60. In an additional embodiment the threads or connection mechanism of the coupling bolt member can be configured to match the design of the gun type used with, such that one of skill in the art could easily make minimal changes for the ultimate connection mechanism. The body to the second end 64 of the bolt member 60 includes a coupling portion 65 on the second end 64 of the coupling bolt member 60. The coupling portion 65 is configured in the shape and dimensions of any typical coupling member used for the delivery of fluid from one container to a second destination while still remaining under pressure. The size of the coupling bolt can vary dependent on the gun it will be used with and can be of any dimensions that will allow for the delivery of the fluid to the gun as well as the size constraints of the available gun chamber used for the cartridge or adaptor system. As an example the coupling bolt member could vary from ¼ of an inch to 12 inches or longer. The coupling bolt member 60 is configured out of any material known in the industry that can include but is not limited to metal, plastic or any machine workable material.

Alternately, the adaptor system may include coupling bolt member 70, the coupling bolt member 70 configuration allows for the coupling bolt member 70 to be placed in connection with a typical gun replacing the cartridge holding piece that creates pressure on a cartridge to ensure an air tight seal is created when the cartridge is engaged within the gun for delivery of the fluid to the gun chamber. The coupling bolt member 70 of the adaptor system is used in place of the holding piece to aide in the placement of the delivery tank 10. The coupling bolt member 70 is further configured with an internal chamber 76 or channel that allows for the delivery of the fluid from a starting fluid tank through the seal member 20 into the delivery chamber and through the delivery tank 10 into the gun. The coupling bolt member 70 can be configured to screw into the gun. In an additional embodiment the coupling bolt member 70 can be configured with any variation to allow for the connection or communication with the gun. The coupling bolt member 70 includes a first end 72 and second end 74. The first end 72 of the coupling bolt member 70 has an indention 73 that is configured to receive the seal member 20, so that a substantially air-tight seal is formed between the flat surface 73 and the seal member 20. The first end 72 includes a configuration of threads 79 that allows for placement within the gun. The threads 79 start at the first end 72 and run to the middle of the coupling bolt member 70. The body to the second end 74 of the bolt member 70 includes a coupling portion 75 on the second end 74 of the coupling bolt member 70. The coupling portion 75 is configured in the shape and dimensions of any typical coupling member used for the delivery of fluid from one container to a second destination while still remaining under pressure. The size of the coupling bolt can vary dependent on the gun it will be used with and can be of any dimensions that will allow for the delivery of the fluid to the gun as well as the size constraints of the available gun chamber used for the cartridge or adaptor system. As an example the coupling bolt member could vary from ¼ of an inch to 12 inches or longer. The coupling bolt member 70 is configured out of any material known in the industry that can include but is not limited to metal, plastic or any machine workable material.

The adaptor system 100 is designed for ease of use by a user and further can be added or removed from the gun with minimal effort and does not require mechanical alteration of the gun as is demonstrated in the figures.

The adaptor system 100 can be delivered to a user as a kit. In order to use a fluid tank a user would first remove the typical single use cartridge from the gun. As an example, after the removal of the cartridge the user would further remove the cartridge holding piece. The cartridge holding piece is replaced with the bolt member 30 by threading the bolt member 30 into the female threads 52 of the gun 50 where the cartridge holding piece is found. After the bolt member 30 is secured in place via the threads found in the bottom end of the handle of the gun 50 the coupling member 40 is threaded onto the second end 34 of the bolt member opposite the head 35 of the bolt member 30. A user can include a sealing tape or other similar sealing material on the threads 39 when the coupling member 40 is screwed onto the bolt member 30 ensuring an air tight configuration. After the coupling member 40 is attached to the bolt member 30 the seal member 20 is seated within the second end 14 of the delivery tank 10. The delivery tank 10 can then be inserted into the cavity 55 of the gun 50 configured for receiving a cartridge. After the delivery tank 10 is positioned in the cavity 55 typically found in the handle of the gun 50 (or wherever the cartridge is located for the gun) the bolt member 30 is adjusted to position the bolt member 30 to create communication, with the seal member 20 intermediate, with the second end 14 of the delivery tank 10 whereby forming an air tight seal of the complete adaptor system 100. A hose is then connected on one end to a fluid tank and on the second end 42 to the coupling member 40. This final connection creates an air tight system configured for the delivery of the fluid from the tank to the gun chamber to ultimately propel a projectile that is delivery via the gun.

In embodiments that use a coupling bolt member 60, the user would first remove the cartridge holding piece. Next the user would remove the cartridge. The cartridge is then replaced by the delivery tank 10. Next, the seal member 20 is seated within the second end 14 of the fluid delivery tank 10. After the seal member 20 is secured in place, the coupling bolt member 60 is threaded into the position previously occupied by the cartridge holding piece. A hose is then connected on one end to a fluid tank and on the second end 64 to the coupling bolt member 60. This final connection creates an air tight system configured for the delivery of the fluid from the tank to the gun chamber to ultimately propel a projectile that is delivery via the gun. Alternately, the coupling bolt member 60, may be replaced with the coupling bolt member 70.

In some embodiments, after the cartridge is removed from the gun, the coupling bolt member 60, may be inserted into the cartridge cavity. A hose is then connected on one end to a fluid tank and on the second end 64 to the coupling bolt member 60. This final connection creates an air tight system configured for the delivery of the fluid from the tank to the gun chamber to ultimately propel a projectile that is delivery via the gun. In other embodiments, after the cartridge is removed from the gun the coupling bolt member 70, may be inserted into the cartridge cavity. A hose is then connected on one end to a fluid tank and on the second end 74 to the coupling bolt member 70. This final connection creates an air tight system configured for the delivery of the fluid from the tank to the gun chamber to ultimately propel a projectile that is delivery via the gun.

Thus, there has been described an adaptor system that can be used with a pneumatic gun for the delivery of a fluid. It is apparent to those skilled in the art, however, that many changes, variations, modifications, other uses, and applications to the support structure method for using are possible, and also such changes, variations, modifications, other uses, and applications which do not depart from the spirit and scope of the invention are deemed covered by the invention, which is limited only by the claims which follow.

Example

By way of example, the adapter embodiment of the pneumatic gun adapter described in FIG. 1 has a delivery tank, a seal member, a bolt member, and a coupling member. The pneumatic gun adapter is shown inside of a pneumatic gun in FIG. 5.

The Powerlet cartridge was removed from a typical pneumatic gun. After the removal of the cartridge the cartridge holding piece was removed. The cartridge holding piece was then replaced with the bolt member by threading the bolt member into the female threads of the gun where the cartridge holding piece is found. After the bolt member was secured in place via the threads found in the bottom end of the handle of the gun the coupling member was threaded onto the second end of the bolt member opposite the head of the bolt member. After the coupling member was attached to the bolt member, the seal member was seated within the second end of the delivery tank. The delivery tank was then inserted into the cartridge cavity of the gun. After the delivery tank was positioned in the cartridge, the bolt member was adjusted to position the bolt member to create communication with the seal member indeterminate, with the second end of the delivery tank whereby forming an air tight seal of the complete adaptor system. A hose was then connected on one end to a fluid tank and on the second end to the coupling member. This final connection created an air tight system configured for the delivery of the fluid from the tank to the gun chamber to ultimately propel a projectile that is delivery via the gun. The pneumatic gun having an adapter system connected to a fluid tank was then tested using the following method:

The fluid tank used for fluid delivery was a California Air Tools, model 15020C-22060, 15 Gallon Ultra Quiet and Oil-Free 2 HP Steel Tank Air Compressor. The pneumatic gun used was a 300 FPS Umarex Combat Zone Enforcer CO2 Non-Blowback.

After installation of the adapter, the cartridge cavity of the pneumatic gun was closed. Crosman Copperhead .177 caliber coated BBs were loaded into the pneumatic gun.

In order to test whether velocity of bbs decreases, a cardboard target was chosen, placed at a point that is one foot closer than where bbs fail to pass through a cardboard target, and the targets were shot at. We then observed whether bbs passed through the cardboard target. Observations were made after 1 shot, 100 shots and 1000 shots.

As expected, each shot passed through the cardboard target. This indicates that when using the pneumatic gun adapter, there was no decrease in pressure delivered to the pneumatic gun.

Thus, there has been described an adapter for a pneumatic gun and a method for using. It is apparent to those skilled in the art, however, that many changes, variations, modifications, other uses, and applications to the drinking straw pump apparatus and method for using are possible, and also such changes, variations, modifications, other uses, and applications which do not depart from the spirit and scope of the invention are deemed to be covered by the invention, which is limited only by the claims which follow.

What is claimed is:

1. An adaptor system for use in a pneumatic gun, the adaptor system comprising:

a delivery tank, wherein the delivery tank includes an internal chamber, a conical funnel shaped first end, a cylindrical body, a bottom end, a first opening and a second opening, wherein the second opening is located on the bottom end of the delivery tank;

a seal member, wherein the seal member is cylindrical and includes a first raised end that fits within the second opening of the delivery tank;

a bolt member, wherein the bolt member includes a head, an outer thread surface below the head, a hollowed core, a first opening, and a second opening, wherein the seal member is intermediate the delivery tank and the bolt member, creating a sealed connection between the delivery tank and the bolt member; and a coupling member wherein, the coupling member includes a first opening and a second opening, the first opening of the coupling member configured to receive the outer thread surface of the bolt member.

2. The adaptor system of claim 1, wherein the conical funnel shaped first end of the delivery tank is configured for connection with the pneumatic gun and the bottom end of the delivery tank is configured with a groove.

3. The adaptor system of claim 1, wherein the seal member is rubber.

4. The adaptor system of claim 1, wherein the delivery tank is aluminum.

5. The adaptor system of claim 1, wherein the coupling member is configured to receive a hose connected to a fluid tank to allow for delivery of fluid via the hose to the pneumatic gun.

6. An adaptor system for use in a pneumatic gun, the adaptor system comprising:

a delivery tank, wherein the delivery tank includes an internal chamber, a conical funnel shaped first end, a cylindrical body, a bottom end, a first opening, and a second opening;

a seal member, wherein the seal member is cylindrical and includes a first raised end that fits_within the second opening of the delivery tank; and a coupling bolt member, wherein the coupling bolt member includes a hollowed core, a first opening, and a second opening, wherein the seal member is intermediate the delivery tank and the coupling bolt member, creating a sealed connection between the delivery tank and the coupling bolt member.

7. The adaptor system of claim 6, wherein the seal member is rubber.

8. A method of converting a pneumatic gun using an internal air cartridge system to a system using a fluid tank external from the pneumatic gun, the method comprising:

providing an adapter system, wherein the adapter system includes a delivery tank, a seal member, a bolt member, and a coupling member, wherein the delivery tank includes an internal chamber, a conical funnel shaped first end with a first opening, a cylindrical body, and a bottom end with a second opening, wherein the seal member is cylindrical and includes a first raised end that fits within the second opening of the delivery tank, wherein the bolt member includes a head, an outer thread surface below the head, and a hollow core with a first opening and a second opening, wherein the seal member is intermediate the delivery tank and the bolt member to create a sealed connection between the delivery tank and the bolt member, and wherein the coupling member includes a first opening and a second opening, the first opening of the coupling member configured to receive the outer thread surface of the bolt member;

threading the bolt member into threads of pneumatic gun;

connecting the adapter system to the fluid tank external from the pneumatic gun; and pulling a trigger of the pneumatic gun.

9. The method of claim 8, wherein, after the bolt member is threaded into the threads of the pneumatic gun, the coupling member is threaded onto the outer thread surface of the bolt member.

10. The method of claim 9, wherein after the coupling member is threaded onto the outer thread surface of the bolt member, the delivery tank is inserted into an air cartridge cavity of the pneumatic gun.

11. The method of claim 10, wherein the connecting step includes attaching one end of a hose to the coupling member, wherein another end of the hose is connected to the fluid tank for delivery of fluid from the fluid tank to the pneumatic gun.

* * * * *